United States Patent [19]

Inage et al.

[11] Patent Number: 4,977,833

[45] Date of Patent: Dec. 18, 1990

[54] LITHOGRAPHIC PLATE FASTENING APPARATUS OF PRINTING PRESS

[75] Inventors: Toyoshi Inage, Kurashiki; Kiyoshi Ito, Niihama, both of Japan

[73] Assignee: Sumitomo Heavy Industries, Ltd., Tokyo, Japan

[21] Appl. No.: 400,228

[22] Filed: Aug. 29, 1989

[30] Foreign Application Priority Data

Mar. 17, 1989 [JP] Japan ..... 01-29729[U]
Mar. 17, 1989 [JP] Japan ..... 01-29730[U]
Mar. 17, 1989 [JP] Japan ..... 01-29731[U]

[51] Int. Cl.[5] ..... B41F 1/28
[52] U.S. Cl. ..... 101/415.1; 101/378
[58] Field of Search ..... 101/415.1, 460, 461, 101/462, 378, 473, 401.1

[56] References Cited

U.S. PATENT DOCUMENTS 2,622,000 12/1952 Thompson ..... 101/415.1
4,259,904 4/1981 Metje ..... 101/401.1
4,459,913 7/1984 Kowalik ..... 101/415.1
4,840,121 6/1989 Szcresniak ..... 101/415.1

FOREIGN PATENT DOCUMENTS 53-6304 7/1951 Japan .
59-1262 1/1984 Japan ..... 101/415.1
6063165 4/1985 Japan ..... 101/415.1

*Primary Examiner*—Edgar S. Burr
*Assistant Examiner*—Ren Yan
*Attorney, Agent, or Firm*—Armstrong, Nikaido, Marmelstein, Kubovcik & Murray

[57] ABSTRACT

A lithographic plate fastening apparatus of a printing press includes a pair of plate vises for fastening a mount plate to a plate cylinder, in a groove defined along the axis of the plate cylinder and includes a plate positioning reference pin provided on a clamping plate of a bite-side plate vise and tightly fitting a reference hole defined in a lithographic plate. The apparatus can rapidly, readily and accurately fasten a thinner lithographic plate e.g. paper plate to the plate cylinder.

5 Claims, 10 Drawing Sheets

LITHOGRAPHIC PLATE FASTENING APPARATUS OF PRINTING PRESS

BACKGROUND OF THE INVENTION

1. Field of the Invention

The present invention relates to a lithographic plate fastening apparatus fastening a lithographic plate to a plate cylinder of a printing press in particular an offset press.

2. Description of the Related Art

In general, a presensitized plate or PS plate made of aluminium, paper plate and resin plate are known as a lithographic plate fastened to a plate cylinder of the offset press.

On one hand, the PS plate and resin plate, which are thick, can print on a large number of printing sheets and on the other hand, they are more expensive than the paper plate and the PS and resin plates which have been clamped by a vise must be fastened to the plate cylinder, so that attachment and detachment works of the PS and resin plates have been troublesome.

Therefore, a paper plate or thinner PS plate has been recently used when the number or printing sheets is small. However, these recent thinner plates are not firmer than conventional PS plates and resin plates, so that the recent thinner plates cannot be fastened directly to the plate cylinder. If they are directly fastened to the plate clyinder, a positioning etc. after a fastening of them to the plate cylinder may produce a wrinkle on them.

Therefore, when the thinner lithographic plate e.g. paper plate has been used in the prior art, a plate-fastening plate 53 fastening the thinner lithographic plate 52 e.g. paper plate to the top surface of a bite-side vise 51 of a plate cylinder 50 is provided as shown in FIGS. 27 and 28, a usual thick plate e.g. the PS plate previously fastened to the plate cylinder 50 constitutes a base plate 54 (a waste-after-use plate may be used as this base plate), and the lithographic plate 52 thinner than the base plate has been hooked on the plate-fastening plate 53 and fastened to the cylindrical surface of the base plate as a support.

When the thinner lithographic plate 52 is positioned relative to the plate cylinder 50, moving the base plate 54 with a thickness equal to that of the usual lithographic plate has moved the thinner lithographic plate 52 and base plate in unit.

The prior-art plate-fastening plate 53 is so arranged that when the thinner lithographic plate 52 e.g. paper plate is fastened to the plate cylinder 50, holes 52' in the lithographic plate 52 are hooked on a large number of hooks 53' provided on the plate-fastening plate 53. Therefore, the hooking is difficult when the breadth of that lithographic plate is great and the lithographic plate is often detached from the hooks 53' on which the lithographic plate has been once hooked, once the lithographic plate waves during a hooking work, so that fastening of the lithographic plate has been time-consuming.

In addition, since the bite-side vise 51 bites and fastens the hooks 53', a gap between a vise bed 5 and a clamping plate 12 must be adjusted by means of a spherical bolt when the usual PS plate is used instead of the paper plate and thinner PS plate. This adjustment is very troublesome.

Consequently, in a small-lot-of printing with the prior-art thinner lithographic plate, the time of exchanging the lithographic plate is longer than an actual printing time, so that a work efficiency has been much reduced.

SUMMARY OF THE INVENTION

The present invention has been made in view of the above-described points. An object of the present invention is to provide a lithographic plate fastening apparatus of a printing press which can rapidly, readily and accurately fasten a thinner lithographic plate e.g. paper plate to a plate cylinder.

In order to achieve the object, the lithographic plate fastening apparatus of the printing press according to the present invention is characterized in that a lithographic plate position of the printing press which includes a bite-side plate vise and a trailing-side plate vise both placed in a groove defined along the axis of a plate cylinder and which includes clamping plates each provided on the top of both the plate vises and clamping a lithographic plate has a plate-positioning reference pin provided on the clamping plate of the bite-side plate vise and tightly fitting a reference hole defined in the lithographic plate.

DESCRIPTION OF THE PREFERRED EMBODIMENTS

The preferred embodiments of the present invention will be described with reference to the drawings hereinafter.

FIGS. 1 through 10 illustrate a first embodiment of the present invention.

Figure 1:
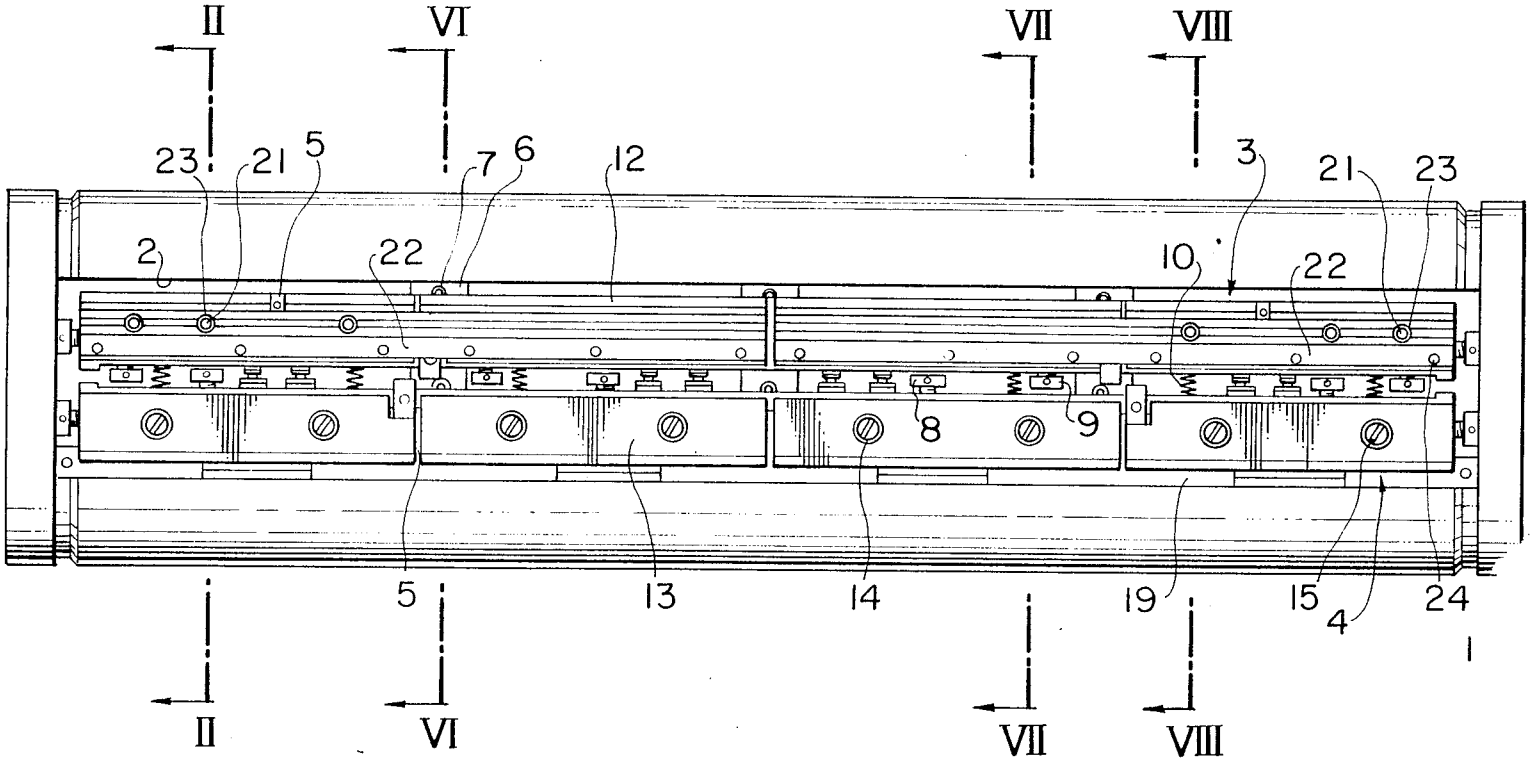
FIG. 1 is a plan view of a plate cylinder of an offset press according to the present invention.
Figure 2:
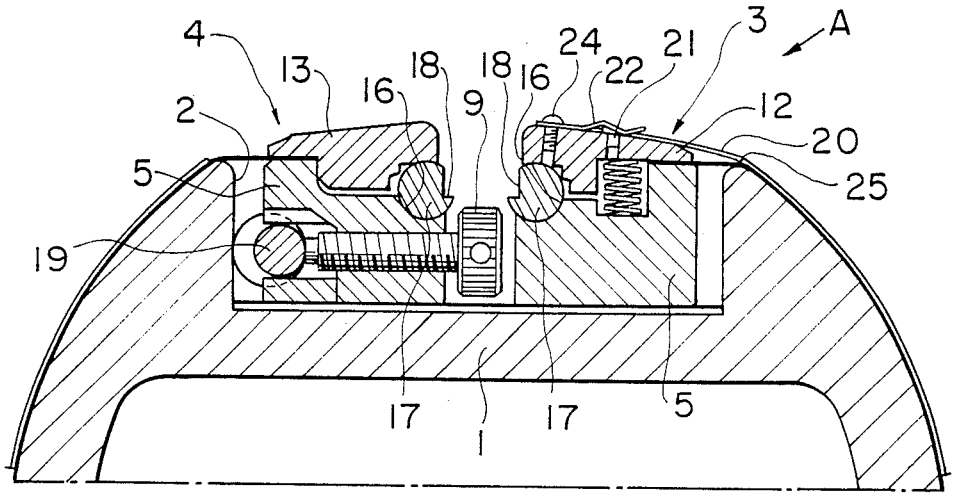
FIG. 2 is an enlarged cross-sectional view of a first embodiment taken along the line II—II in FIG. 1.
Figure 6:
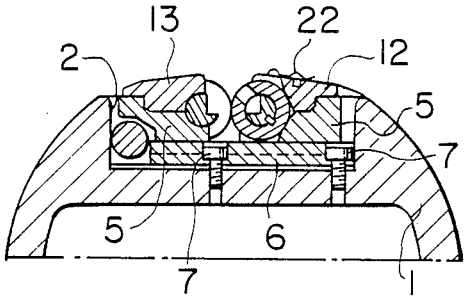
FIG. 6 is a cross-sectional view of the plate cylinder taken along the line VI—VI in FIG. 1.
Figure 7:
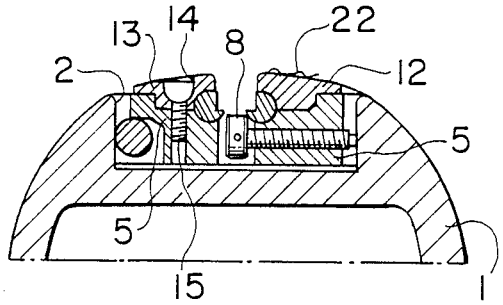
FIG. 7 is a cross-sectional view of the plate cylinder taken along the line VII—VII in FIG. 1.
Figure 8:
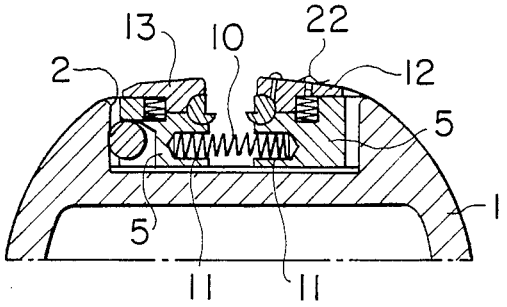
FIG. 8 is a cross-sectional view of the plate cylinder taken along the line VIII—VIII in FIG. 1.

In FIG. 1, a plate cylinder is indicated at 1 and the plate cylinder 1 defines a groove 2 extending over the full length of the plate cylinder 1 and receiving a plate bite side plate vise 3 and a plate trailing side plate vise 4. The groove 2 also receives vise benches 5,5 each of which is slightly shorter than the full length of the groove 2 and has an essentially rectangular cross-section. As shown in FIG. 6, the bottom of each of the vise benches 5,5 defines a dovetail groove fitting a retainer 6 which is fastened by bolts 7 to the bottom of the groove 2. Therefore, the retainer 6 checks a relief of each of the vise benches 5,5 from the bottom surface of the groove 2. Bolts positioning the vise benches 5,5 relative to the plate cylinder 1 are indicated at 8,9. Pluralities of the bolts 8,9 are provided along the axes of the vise benches 5,5. A plurality of compression springs seated between opposite holes 11 in the vise benches 5,5 are indicated at 10. The compression springs 10 urge the respective vise benches 5,5 to the opposite wall surfaces of the groove 2. Clamping plates each of which is so long as to divide the length of each of the vise benches 5,5 into essentially equal four in the axis of the plate cylinder 1 are indicated at 12,13. Each of the clamping plates 12,13 has two boltholes 14 each with a spherical seat.

Each of the vise benches 5,5 includes tapped holes each opposite to the boltholes 14. Spherically-headed bolts 15 fasten the clamping plates 12,13 to the vise benches 5,5. A nonclamping side of each of the vise benches 5,5 defines a groove 16 with a semicircular cross-section and extending in the full length of that vise bench 5. Each of the grooves 16 carries a clamp shaft 17 therein.

The clamp shaft 17 defines a notch 18 with an L-shaped cross-section. A rotation of each of the clamp shafts 17,17 enables one edge portion of the clamping plate 12 or 13 to engage with the notch 18. Thus, each of the clamping plates 12,13 is pivotably supported by a combination of the spherically-headed bolt 15 and spherical seat.

An eccentric shaft 19 extending over the full length of the plate cylinder 1 is seated between a clamping side edge surface of the plate trailing side vise bench 5 and one side wall surface of the groove 2. A rotation of the eccentric shaft 19 enables the plate trailing side plate vise 4 to slide towards the plate bite side plate vise 3.

Thus, the plate bite side plate vise 3 bites one end of the PS or resin plate each with an usual thickness, then the PS or resin plate is wound on the plate cylinder 1, and then the plate trailing side plate vise 4 fastens the other end of the PS or resin plate to the plate cylinder 1.

The above-described basic arrangement is the same as that of a prior-art plate cylinder.

The top portion of each of the clamping plates 12 of the plate cylinder 1 of the present invention as arranged above has plate-positioning reference pins 21 provided at positions opposite to reference holes 20*a* defined in a thinner lithographic plate 20 e.g. paper plate or about 0.15 mm–0.24 mm PS plate. A head 21*a* of each of the reference pins 21 has a diameter essentially equal to that of each of the reference holes 20*a* in the thinner lithographic plate 20 and has a wedge-shaped elevation taken axially of the plate cylinder 1. That is, the head 21*a* tapers to the bited side of a lithographic plate.

In accordance with the present embodiment, the axially opposite ends of the clamping plate 12 each situated at the opposite ends of the plate cylinder 1 each have sets of three reference pins 21. However, the number of reference pins 21 will not be restricted to the above number and a suitable number thereof may, of course, be selected.

Retaining plates preventing a relief of a plate ends of the thinner lithographic plate 20 are indicated at 22. Each of the retaining plates 22 is in a waved form. A nonclamping-side end of each of the retaining plates 22 is fastened by bolts 24 to the top surface of the clamping plate so as to cover the reference pins 21.

That is, one side of the retaining plate 22 has a portion bent at angles corresponding to the wedge-shaped elevation of the head 21*a* of each of the reference pins 21 and a clamping side of the retaining plate 22 is bent upwards so as to facilitate an insertion of the thinner lithographic plate 20. A portion of the retaining plate 22 opposite to each of the reference pins 21 defines a hole 23 larger than the head 21*a* of a corresponding reference pin 21. When the plate end of the thinner lithographic plate 20 is inserted between the clamping plates 12 and the retaining plates 22 and the reference pins 21 are fitted into the reference holes 20*a* in the thinner lithographic plate 20, the holes 23 defined in the retaining plates 22 facilitate a confirmation of spatial relations between the reference holes 20*a* in the thinner lithographic plate 20 and the reference pins 21 while the reference holes 20*a* are fitted on the reference pins 21.

Figure 9:
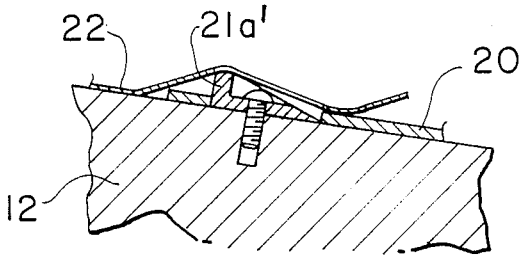
FIG. 9 is an illustration of another reference pin corresponding to that of FIG. 3.
Figure 10:
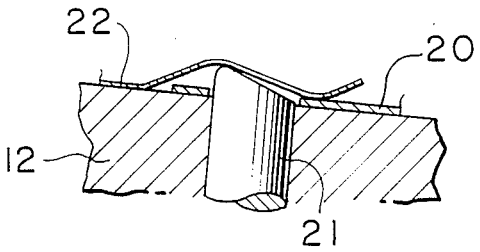
FIG. 10 is an illustration of another reference pin corresponding to that of FIG. 3.

The full length of each of the retaining plates 22 may be determined in response to an adjustment range of the clamping plates 12 and in accordance with the present embodiment, are equal to the total length of two of the clamping plates 12. Each of the reference pins 21 of the present embodiment has the form of a headed pin with the wedge-shaped head 21*a*. However, that reference pin 21 will not be restricted to this form and as shown in FIG. 9, may alternatively be an element 21*a*′ with an L-shaped section attached to the clamping plate by a bolt or the like or may alternatively be a cylindrical pin 21 with an oblique top edge surface as shown in FIG. 10.

While each of the retaining plates 22 defines the holes 23, each of the holes 23 may alternatively have so various shapes that a corresponding reference pin 21 could be visually confirmed. When each of the retaining plates 22 is made of a transparent material e.g. transparent plastic resin, the holes 23 may be eliminated.

Hereinafter, the fastening of the thinner lithographic plate e.g. paper plate carried out by the lithographic plate fastening apparatus of the present embodiment will be described.

First, the plate bite side plate vise 3 and plate trailing side plate vise 4 together fasten a mount plate 25 or a usually thick plate e.g. PS plate instead of the mount plate 25 each constituting a base to the plate cylinder 1. Therefore, when the usually thick plate e.g. PS plate is previously fastened to the plate cylinder 1 and can be used as the mount plate 25, a new mount plate need not be fastened.

Figure 3:
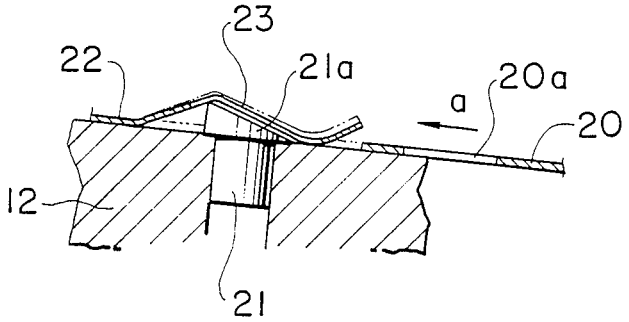
FIG. 3 is an enlarged view of an A-portion of FIG. 2.
Figure 4:
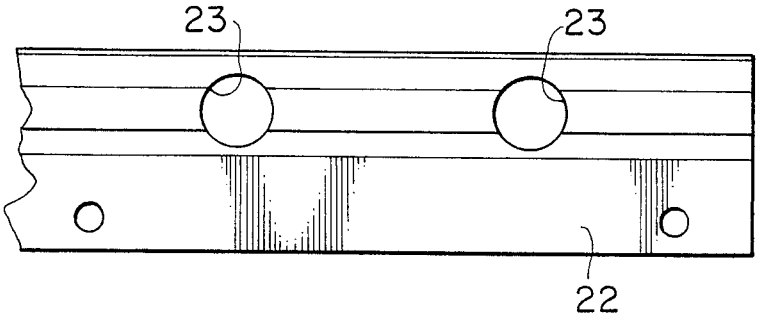
FIG. 4 is a plan view of a fragment of a retaining plate 22 used with an embodiment of FIG. 3.
Figure 5:
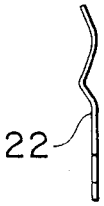
FIG. 5 is a cross-sectional view of the retaining plate 22 of FIG. 4.

As shown in FIG. 3, the bited-side end with the reference holes 20*a* of the thinner lithographic plate 20 e.g. paper plate is inserted in the direction of the arrow a between the top surfaces of the clamping plates 12 and the undersides of the front ends of the retaining plates 22, and the reference holes 20*a* in the thinner lithographic plate 20 are fitted on the reference pins 21.

In this case, since the head 21*a* of each of the reference pins 21 has the wedge shape tapering towards the bited-side end of the lithographic plate 20, the insertion of the lithographic plate 20 is smoothly carried out and the holes 23 in the retaining plates 22 can facilitate the visual confirmation of the relative positions between the reference holes 20*a* in the thinner lithographic plate 20 and the reference pins 21 during the insertion.

Once the reference holes 20*a* in the thinner lithographic plate 20 fit on the reference pins 21, the lithographic plate 20 is mounted around the plate cylinder 1 along the mount plate 25 and adhered to the mounting plate 25 with water, oil or an adhesive which is previously applied to the entire surface of the lithographic plate 20 or a pressure sensitive adhesive double coated tape which is previously attached to the mount plate 25. Thus, the thinner lithographic plate 20 is fastened by means of the mount plate 25 to the plate cylinder 1. Thus, adjusting the position of each of the plate bite side and plate trailing side plate vises 3,4 which are clamping the mount plate 25 will cause an adjustment of the spatial relation between the thinner lithographic plate 20 and the plate cylinder 1.

On the other hand, when the thinner lithographic plate 20 e.g. paper plate is detached from the plate cylinder 1, the trailing end of the lithographic plate 20 is detached from the plate cylinder 1, gripped and pulled away from the plate cylinder 1, so that the lithographic plate 20 can be readily detached from the reference pins 21.

In according to the present embodiment, inserting the bited-end of the thinner lithographic plate e.g. paper plate between the clamping plates and the retaining plates moves the bited-end of the lithographic plate along the oblique surface of the wedge-shaped head of each positioning reference pin, so that the positioning reference pins and reference holes can readily and accurately fit each other. In addition, since the retaining plates depress and retain the bited-end of the thinner lithographic plate, once the reference holes in the bited-end of the thinner lithographic plate fit the reference pins, advantages that the lithographic plate will not be detached from the reference pins and relieved are produced.

Hereinafter, a second embodiment of the present invention will be described with reference to FIGS. 11 through 15.

Also in accordance with the second embodiment as in the first embodiment, the top portion of each of the clamping plates 12 of the plate cylinder 1 has the positioning reference pins 21 provided at positions opposite to the reference holes 20*a* defined in the thinner lithographic plate 20 e.g. paper plate or about 0.15 mm–0.24 mm PS plate.

The head 21*a* of each of the reference pins 21 has a diameter slightly smaller than a diameter of a body of the reference pin 21 and essentially equal to a corresponding reference hole 20*a* in the thinner lithographic plate 20. The head 21*a* of each of the reference pins 21 has a wedge-shaped elevation taken axially of the plate cylinder 1. That is, the top oblique surface 21*c* of the head 21*a* tapers to the bited side of the lithographic plate.

Each of the clamping plates 12 includes holes 26 fitting the reference pins 21. A neck 26*b* of each of the holes 26 has a diameter essentially equal to the diameter of the head 21*a* of the reference pin 21. A spring 27 projecting the head 21*a* of the reference pin 21 from the top surface of the clamping plate is seated in the hole 26 so as to be in contact with the underside of the reference pin 21.

The modulus of the spring 27 is lower than a force depressing the reference pin 21 into the hole 26 when the lithographic plate 20 is inserted between retaining plates 22 as described and the clamping plates 12 below.

A hole 23 defined in each of the retaining plates 22 is provided in order to allow the top of the head 21*a* of the reference pin 21 to project from the top surface of the clamping plate 12. Alternatively, means for allowing the head 21*a* to project from the top surface of the clamping plate 12 may be a notch 28 of FIG. 13 in the form of a slot extending from an edge of the retaining plate 22 situated on the clamping-side end of the clamping plate 12.

Hereinafter, the fastening of the thinner lithographic plate e.g. paper plate carried out by the lithographic plate fastening apparatus of the second embodiment will be described.

Figure 11:
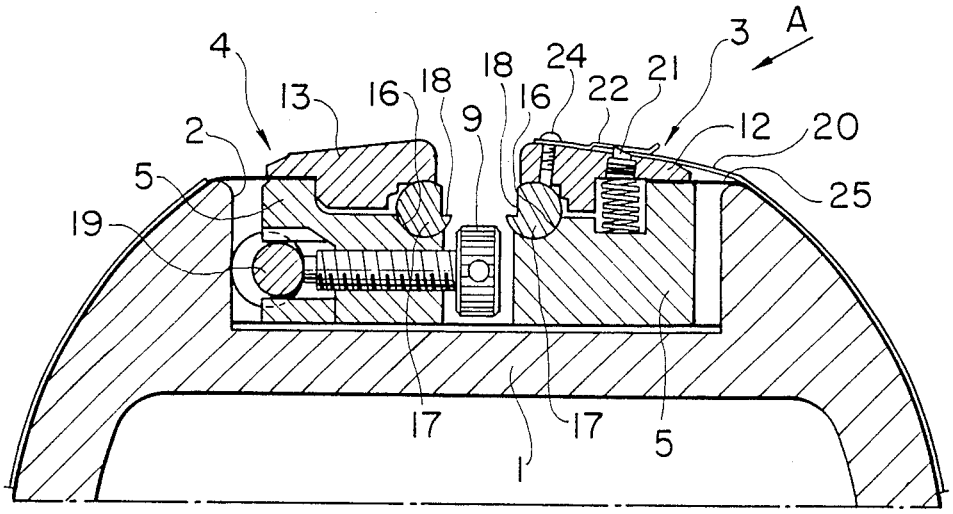
FIG. 11 is an enlarged cross-sectional view of a second embodiment similar to FIG. 2.
Figure 12:
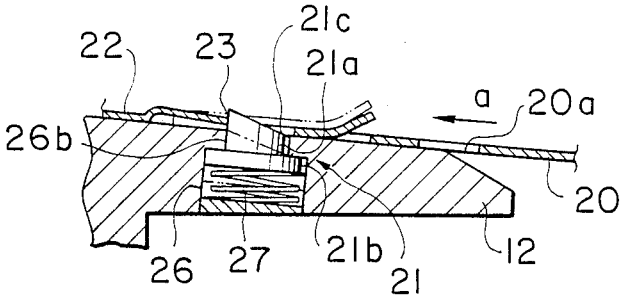
FIG. 12 is an enlarged view of an A-portion of FIG. 11.
Figure 13:
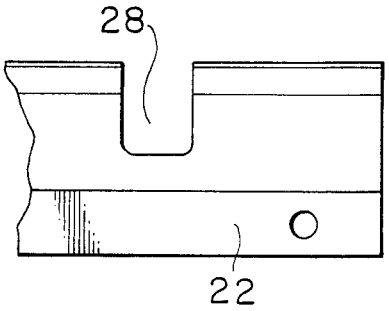
FIG. 13 is a plan view of a fragment of another retaining plate used with the embodiment of FIG. 12.
Figure 14:
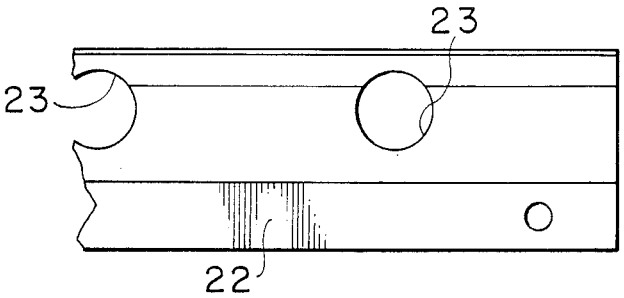
FIG. 14 is a plan view of a fragment of another retaining plate used with the embodiment of FIG. 12.

First, the plate bite side plate vise 3 and plate trailing side plate vise 4 together fasten a mount plate 25 or the usually thick plate e.g. PS plate instead of the mount plate 25 each constituting base to the plate cylinder 1. Therefore, when the usually thick plate e.g. PS plate is previously fastened to the plate cylinder 1 and serves as the mount plate 25, a new mount plate need not be fastened. The mount plate 25 is fastened to the plate cylinder 1 and then, as shown in FIG. 11, the bited-side end with the reference holes 20*a* of the thinner lithographic plate 20 e.g. paper plate is inserted in the direction of the arrow a between the top surfaces of the clamping plates 12 and the undersides of the front ends of the retaining plates 22, and the reference holes 20*a* in the thinner lithographic plate 20 are fitted on the reference pins 21.

In this case, as the bited-side end or front end of the lithographic plate 20 passes through gaps between the retaining plates 22 and oblique surfaces 21C of the reference pins 21, the oblique surfaces 21C of the reference pins 21 tend to elevate therealong the bited-side end of the lithographic plate 20. However, since the retaining plates 22 depress the top surface of the bited-side end of the lithographic plate 20, the bited-side end of he lithographic plate 20 proceeds straightforwards through the gaps between the clamping plates 12 and the retaining plates 22 without turning upwards.

A component due to the oblique surfaces 21C of the insertion force of the lithographic plate 20 proceeding in the direction of the arrow a serves by assist of the retaining plates 22 to depress the reference pins 21 within the holes 26.

Then, when the reference holes 20a in the lithographic plate 20 reach positions right above the reference pins 21, the forces of the springs 27 project the reference pins 21 from the top surfaces of the clamping plates 12, so that the reference pins 21 accurately positions the lithographic plate 20. At this time, the reference pins 21 can be fitted in to the reference holes 20a in the lithographic plate 20 while the relative positions between the reference holes 20a and the reference pins 21 are visually confirmed by means of the holes 23 defined in the retaining plates 22.

As in the first embodiment, once the reference holes 20a in the lithographic plate 20 fit the reference pins 21, the lithographic plate 20 is mounted to the plate cylinder 1 along the mount plate 25 and the trailing-side end of the lithographic plate 20 is adhered with water, the pressure sensitive adhesive double coated tape or adhesive to the mount plate 25. Thus, the lithographic plate 20 is fastened by means of the mount plate 25 to the plate cylinder 1.

Thus, adjusting the position of each of the plate bite side and plate trailing side plate vises 3,4 which are clamping the mount plate 25 will cause an adjustment of the spatial relation between the thinner lithographic plate 20 and the plate cylinder 1.

On the other hand, when the lithographic plate 20 is detached from the plate cylinder 1, the trailing end of the lithographic plate 20 is detached from the plate cylinder 1, gripped and pulled away from the plate cylinder 1, so that the lithographic plate 20 can be readily detached from the reference pins 21.

Figure 15:
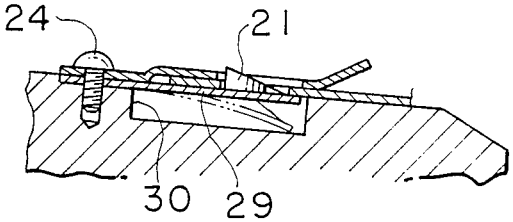
FIG. 15 is an illustration of another reference pin corresponding to that of FIG. 12.
Figure 16:
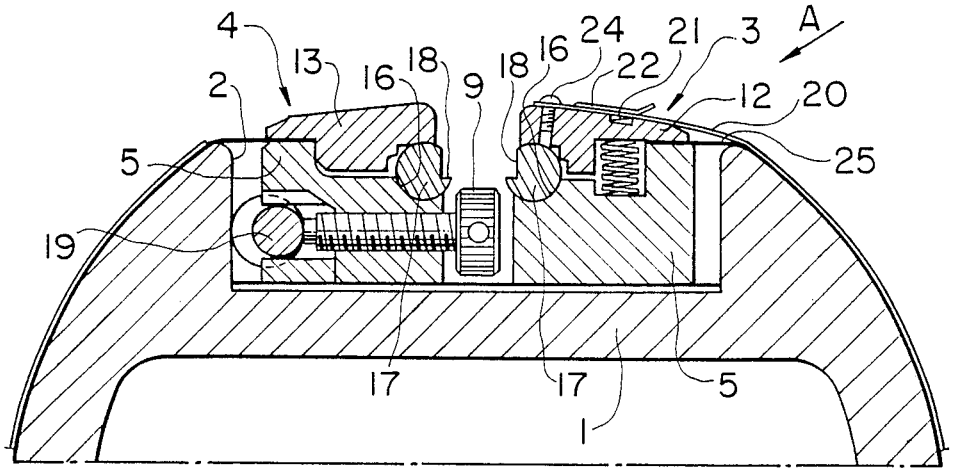
FIG. 16 is an enlarged cross-sectional view of a third embodiment similar to FIG. 2.

In accordance with the second embodiment, the springs 27 can project the lithographic plate positioning reference pins 21 from the top surfaces of the clamping plates 12. However, alternatively, as shown in FIG. 15, leaf springs 29 may be mounted by means bolts 24 or the like to the top surfaces of the clamping plates 12 so that the top surfaces of the leaf springs 29 are flush with the top surfaces of the clamping plates 12, the front ends of the leaf springs 29 may each have the lithographic plate positioning reference pins 21 fastened thereto, and the top surfaces of the clamping plates 12 may define grooves 30 so that the leaf springs 29 can swing about the mounted portion thereof, whereby the reference pins 21 may project from and be placed under the top surfaces of the clamping plates 12.

Thus, also in accordance with the second embodiment, inserting the bited-end of the thinner lithographic plate e.g. paper plate between the clamping plates and the retaining plates depresses the reference pins from the top surfaces of the clamping plates. Once the reference holes in the lithographic plate coincide with the reference pins, the reference pins project from the top surfaces of the clamping plates to automatically fit into the reference holes, so that the reference holes in the lithographic plate and the reference pins can readily and accurately fit each other.

In addition, since the retaining plates depress and retain the bited-end of the thinner lithographic plate once the reference holes in the bited-end of the lithographic plate fit the reference pins, advantages that the lithographic plate which has been inserted will not be detached from the reference pins and relieved are produced.

Hereinafter, a third embodiment of the present invention will be described with reference to FIGS. 1 and 16 through 19.

Also in accordance with the third embodiment as in the first and second embodiments, the top surfaces of the clamping plates 12 of the plate cylinder 1 have retaining plates 22 fastened thereto and preventing a relief of the bited-end of the thinner lithographic plate 20 e.g. paper plate or about 0.15 mm–0.24 mm PS plate. Non-clamping side ends of the retaining plates 22 are fastened by bolts 24 to the top surfaces of the clamping plates 12 and on the other hand, clamping side ends of the retaining plates 22 are bent upwards so as to readily receive the bited-end of the lithographic plate 20. Portions of the undersides of the retaining plates 22 opposite to the reference holes 20a in the lithographic plate 20 each have plate positioning reference pins 21.

Each of the reference pins 21 has a diameter essentially equal to that of a corresponding reference pin 20a in the lithographic plate 20. Each of the reference pins 21 has a wedge-shaped elevation taken axially of the plate cylinder 1 and tapers towards the bited side of the lithographic plate. The top portions of the clamping plates 12 opposite to the reference pins 21 each have recesses 31 each of which is so large as to receive a corresponding reference pin 21.

Each of the retaining plates 22 is flexible so that the thrust of the lithographic plate 20 which is being inserted between the retaining plates 22 and clamping plates 12 can readily flex the retaining plates 22.

Hereinafter, the fastening of the thinner lithographic plate e.g. paper plate carried out by the lithographic plate fastening apparatus of the third embodiment will be described.

Figure 17:
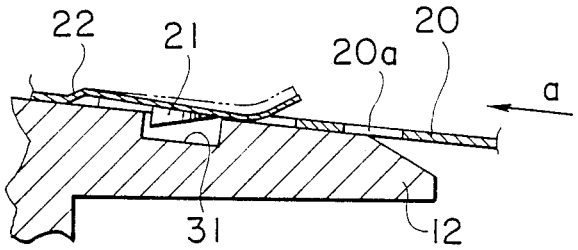
FIG. 17 is an enlarged view of an A-portion of FIG. 16.

First, the plate bite side plate vise 3 and plate trailing side plate vise 4 together fasten the usually thick mount plate 25 e.g. PS plate as the base to the plate cylinder 1. Therefore, when the usually thick plate e.g. PS pate is previously fastened to the plate cylinder 1 and serves as the mount plate 25, a new mount plate need not be fastened. The mount plate 25 is fastened to the plate cylinder 1 and then, as shown in FIG. 17, the bite-side end with the reference holes 20a of the thinner lithographic plate 20 e.g. paper plate is inserted in the direction of the arrow a between the top surfaces of the clamping plates 12 and the undersides of the front ends of the retaining plates 22, and the reference holes 20a in the thinner lithographic plate 20 are fitted on the reference pins 21.

In this case, as the bited-side end or front end of the lithographic plate 20 passes through gaps between the retaining plates 22 and bottom oblique surfaces of the reference pins 21, the bottom oblique surfaces of the reference pins 21 elevate the retaining plates 22 about positions of the retaining plates 22 fastened by bolts 24.

Then, once the reference holes 20a in the lithographic plate 20 reach positions right under the reference pins 21, the resilient return forces of the retaining plates 22 causes the reference pins 21 to fit into the reference holes 20a in the lithographic plate 20 thereby to accurately position the lithographic plate 20. Then, as in the first and second embodiments, once the reference holes 20a in the lithographic plate 20 fit the reference pins 21, the lithographic plates 20 is mounted to the plate cylinder 1 along the mount plate 25 and the trailing-side end of the lithographic plate 20 is adhered with water, the pressure sensitive adhesive double coated tape or adhesive to the mount plate 25.

Thus, the lithographic plate 20 is fastened by means of the mount plate 25 to the plate cylinder 1. Thus, adjusting the position of each of the plate bite side and plate trailing side plate vises 3,4 which are clamping the mount plate 25 will cause an adjustment of the spatial relation between the thinner lithographic plate 20 and the plate cylinder 1.

On the other hand, when the lithographic plate 20 is detached from the plate cylinder 1, the trailing end of the lithographic plate 20 is detached from the plate cylinder 1, gripped and pulled away from the plate cylinder 1, so that the lithographic plate 20 can be readily detached from the reference pins 21.

Figure 18:
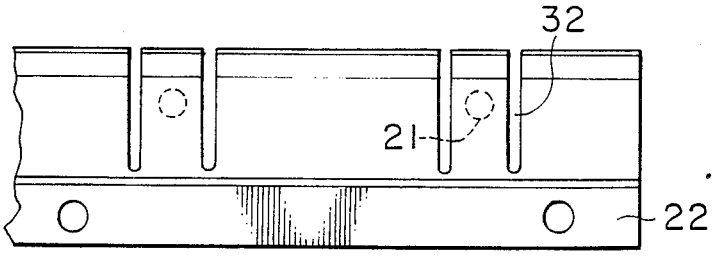
FIG. 18 is a plan view of a fragment of another retaining plate used with an embodiment of FIG. 17.
Figure 19:
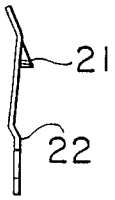
FIG. 19 is a cross-sectional veiw of the retaining plate of FIG. 18.
Figure 20:
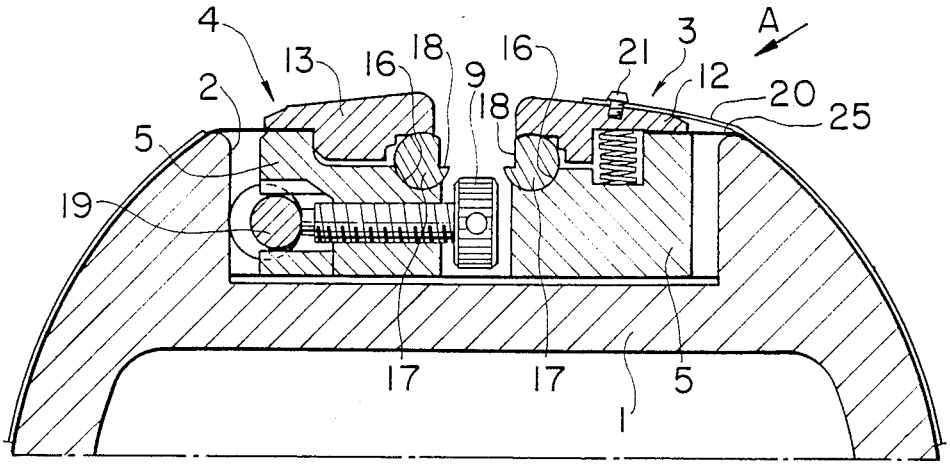
FIG. 20 is an enlarged cross-sectional view of a fourth embodiment similar to FIG. 2.

Since only the portions of the retaining plates 22 with the reference pins 21 attached thereto must bend upwards when the lithographic plate 20 is fastened to the plate cylinder 1, two slits 32 each extending along the direction of bending of the retaining plates 22 i.e. transversely to the axes of the retaining plates 22 are defined near each portion of the retaining plates 22 with the reference pin 21 attached thereto, as shown in FIG. 18. Thus, the portions of the retaining plates 22 with the reference pins 21 attached thereto can readily flex.

In addition, when the retaining plates 22 are made of a transparent material (e.g. plastic resin), the reference pins 20*a* in the lithographic plate 20 are visually confirmed, so that the lithographic plate 20 can be readily fastened.

Since in accordance with the third embodiment, inserting the bited-side end of the thinner lithographic plate e.g. paper plate between the clamping plates and the retaining plates causes the retaining plates to bend upwards to turn the reference pins upwards from the top surfaces of the clamping plates and once the reference holes in the lithographic plate coincide with the reference pins, the reference pins pass through the reference holes into recesses defined in the top portions of the clamping plates so that the reference holes automatically fit the reference pins, the alignments between the reference holes in the lithographic plate and the reference pins can be readily carried out.

In addition, since the retaining plates depress and retain the bited-end of the thinner lithographic plate once the reference holes in the bited-end of the lithographic plate fit the reference pins, advantages that the lithographic plate which has been inserted will not be detached from the reference pins and relieved are produced.

Hereinafter, a fourth embodiment of the present invention will be described with reference to FIGS. 1 and 20 through 26.

Also in accordance with the fourth embodiment as in the first embodiment, the top portions of the clamping plates 12 of the plate cylinder 1 have plate positioning reference pins 21 provided at positions opposite to the reference holes 20*a* in the thinner lithographic plate 20 e.g. paper plate or about 0.15 mm–0.24 mm PS plate.

Figure 21:
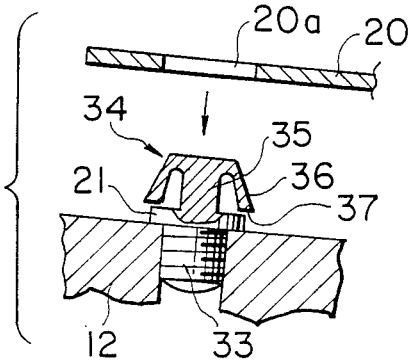
FIGS. 21–23 are enlarged views of a A-portion of FIG. 20, illustrating the operation of a plate retaining element.
Figure 22:
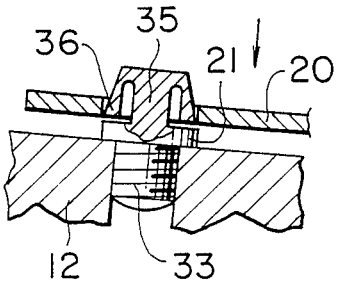
Figure 23:
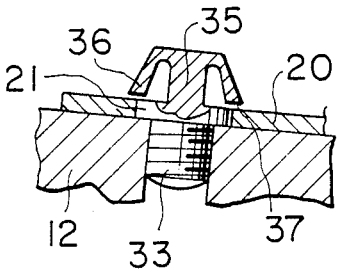
Figure 24:
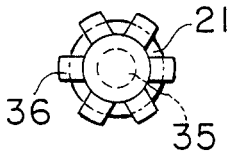
FIG. 24 is a plan view of the plate retaining element of FIG. 21.
Figure 25:
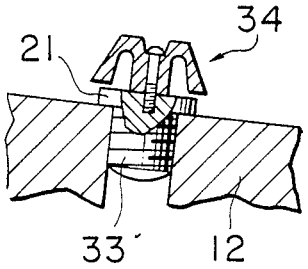
FIG. 25 is an illustration of another plate retaining element.
Figure 26:
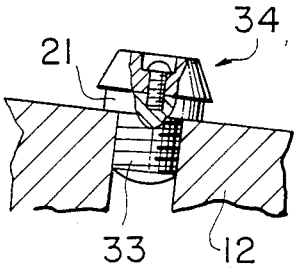
FIG. 26 is an illustration of another plate retaining element.
Figure 27:
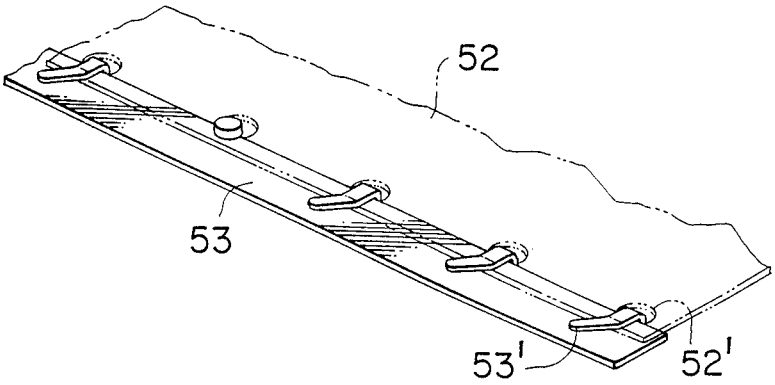
FIG. 27 PRIOR ART
FIG. 27 is a perspective view of a prior-art paper plate fastening plate.
Figure 28:
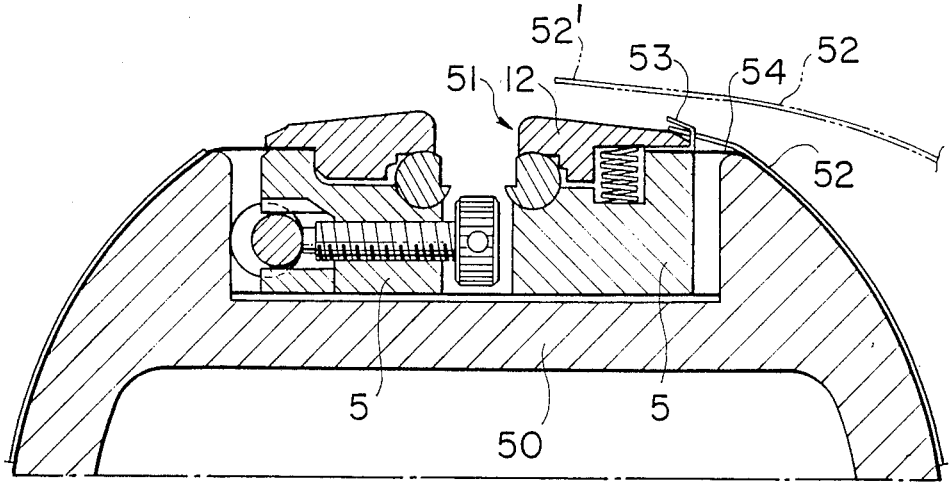
FIG. 28 PRIOR ART
FIG. 28 is an illustration of a position in which the paper plate fastening plate of FIG. 27 is fastened to a plate cylinder.

Each of the reference pins 21 has a major diameter essentially equal to a corresponding reference hole 20*a* in the lithographic plate 20 and has a screw-threaded lower portion 33. The screw-threaded lower portions 33 serve to screw the reference pins 21 to the clamping plates 12. Each of plate retaining elements 34 and a corresponding reference pin 21 are formed in one-piece form at the top end of the reference pin 21, as shown in FIGS. 21 through 23, or separately formed and combined with each other, as shown in FIGS. 25 and 26.

The plate retaining element 34 is made of an elastic material e.g. synthetic resin or rubber, has a shaft 35 standing from the center of the top surface of the reference pin 21 and has a plurality of elastic legs 36 extending obliquely downwards and radially from the top portion of the shaft 35. The outer edge of the bottom of each of the elastic legs 36 has a diameter normally slightly larger than the reference hole 20*a* in the lithographic plate 20.

When the reference holes 20*a* in the lithographic plate 20 are fitted onto the plate retaining elements 34 from above to fit on the elastic legs 36, the elastic legs 36 bend inwardly radially of each of the plate retaining elements 34 against the elasticities of the elastic legs 36 so as to reduce the major diameter of each elastic leg 36. When the major diameter of each elastic leg 36 becomes essentially equal to the diameter of the reference hole 20, the lithographic plate 20 cleans the elastic legs 36.

The plate retaining element 34 with six elastic legs 36 has been illustrated above. However, the number of the elastic legs 36 of each plate retaining element 34 will not be limited to six and can be suitably selected. The screw-threaded portion 33 of each reference pin 21 is screwed to the clamping plate 12. However, the screw-threaded portion 33 of each reference pin 21 may alteratively be replaced by a hollow round cylinder. This hollow round cylinder of each reference pin 21 may be thrust into the clamping plate 12 and retained therewithin by the elastic force of the hollow cylinder.

Hereinafter, the fastening of the thinner lithographic plate e.g. paper plate carried out by the lithographic plate fastening apparatus of the fourth embodiment will be described.

As in the first to third embodiments, the plate bite side plate vise 3 and the plate trailing side plate vise 4 first together fasten the usually thick mount plate 25 or PS plate instead of the mount plate 25 as the base to the plate cylinder 1. Therefore, when the usually thick plate e.g. PS plate is previously fastened to the plate cylinder and serves as the mount plate 25, a new mount plate 25 need not be fastened.

The mount plate 25 is fastened to the plate cylinder 1 and then, as shown in FIGS. 21 through 23, the reference pins 20*a* in the thinner lithographic plate 20 e.g. paper plate are aligned with the reference pins 21 and fitted thereonto from above. Since the diameter of each reference hole 20*a* in the lithographic plate 20 is slightly smaller than the major diameter of the assembly of the bottom edges of the elastic legs 36, the edge surface of each reference hole 20*a* in the lithographic plate 20 flexes the elastic legs 36 about the top positions of the elastic legs 36 so that the bottom edges of the elastic legs 36 move inwards radially of the plate retaining element 34 when the lithographic plate 20 passes past the elastic legs 36. That is, the major diameter of the assembly of the bottom edges of the elastic legs 36 is reduced.

When the reference holes 20*a* in the lithographic plate 20 have cleaned the elastic legs 36, the elastic legs 36 restore their initial shapes by the elasticities thereof. Therefore, the major diameter of the assembly of the bottom edges of the elastic legs 36 again becomes larger than the diameter of each reference hole 20*a* in the lithographic plate 20 and the undersides 37 of the elastic legs 36 depress the top surface of the lithographic plate 20 so as to prevent a relief of the lithographic plate 20.

Thus, after the reference holes 20*a* in the lithographic plate 20 fit the reference pins 21, the lithographic plate 20 is mounted to the plate cylinder along the mount plate 25 and the trailing-side end of the lithographic plate 20 is adhered with water, the pressure sensitive adhesive double coated tape or adhesive to the mount plate 25.

Thus, the lithographic plate 20 is securely fastened by means of the mount plate 25 to the plate cylinder 1.

Thus, adjusting the position of each of the plate bite side and plate trailing side plate vises 3,4 which are clamping the mount plate 25 will cause to adjust the spatial relation between the thinner lithographic plate 20 and the plate cylinder 1, as a normally thick plate is fastened.

As shown in FIG. 26, the plate retaining element 34 may be of a truncated circular cone.

In this case, a material having elasticity greater than a material for the elastic legs 36 (i.e. a more flexible material), e.g. synthetic resin or crude rubber, is preferably used.

In accordance with the fourth embodiment, simply aligning the reference holes in the thinner lithographic plate e.g. paper plate with the reference pins and fitting each other can cause the alignment of the lithographic plate, so that fastening the lithographic plate to the plate cylinder 1 can be rapidly and accurately carried out.

In addition, since the undersides of the plate retaining element depress the top surface of the bited-end of the lithographic plate once the reference holes in the bited-end of the lithographic plate fit the reference pins, the relief of the lithographic plate can be prevented and an advantage that the lithographic plate which has been inserted can be securely prevented from being detached from the reference pins is produced.

In addition, when the reference pin and the plate retaining element are separately formed and the plate retaining element is detachable from the reference pin, the plate retaining element which has been broken or worn can be readily replaced.

While the invention has been particularly shown and described in reference to preferred embodiments thereof, it will be understood by those skilled in the art that changes in form and details may be made therein without departing from the spirit and scope of the invention.

What is claimed is:

1. A lithographic plate fastening apparatus of a lithographic plate positioner for a plate cylinder of a printing press for fastening a combination of a lithographic plate and a mount plate, said lithographic plate having at least one reference hole and being positioned on top of said mount plate, the lithographic plate positioner including a bite-side plate vise and a trailing-side plate vise both placed in a groove defined along the axis of the plate cylinder, the top portion of each of the plate vises having the clamping plate clamping a mount plate, the lithographic plate fastening apparatus comprising:

a plate positioning reference pin provided on the clamping plate of the bite-side plate vise and tightly fitting a reference hole defined in a lithographic plate and a lithographic plate-retaining plate mounted on the top surface of the clamping plate placed above the plate positioning reference pin, the retaining plate depressing the top surface of the lithographic plate fitting the plate positioning reference pin.

2. A lithographic plate fastening apparatus as recited in claim 1, wherein the plate positioning reference pin is elastically supported on the top surface of the clamping plate of the bite-side plate vise so as to project from and be placed under the top surface of the clamping plate of the bite-side plate vise.

3. A lithographic plate fastening apparatus as recited in claim 1, 2 or 5, wherein the plate-positioning reference pin has a head tapering towards a bited-side of the lithographic plate.

4. A lithographic plate fastening apparatus of a lithographic plate positioner for a plate cylinder of a printing press for fastening a combination of a lithographic plate and a mount plate, said lithographic plate having at least one reference hole and being positioned on top of said mount plate, the lithographic plate positioner including a bite-side plate vise and a trailing-side plate vise both placed in a groove defined along the axis of the plate cylinder, the top portion of each of the plate vises having a clamping plate for clamping the mount plate, wherein the top portion of the clamping plate of the bite-side plate vise has a plate positioning reference pin fastened thereto and a head of the plate positioning reference pin has a plate retaining element mounted thereto, the plate retaining element having a diameter normally, slightly larger than a diameter of the plate positioning reference pin and being diametrically resilient.

5. A lithographic plate fastening apparatus of a lithographic plate positioner for a plate cylinder of a printing press for fastening a combination of a lithographic plate and a mount plate, said lithographic plate having at least one reference hole and being positioned on top of said mount plate, the lithographic plate positioner including a bite-side plate vise and a trailing-side plate vise both placed in a groove defined along the axis of the plate cylinder, the top portion of each of the plate vises having a clamping plate for clamping the mount plate, the lithographic plate fastening apparatus comprising:

a plate retaining plate mounted on the top surface of the clamping plate of the bite-side plate vise and;

a plate positioning reference pin provided on the undersurface of the plate retaining plate and fitting a reference hole defined in the lithographic plate, the clamping plate being mounted above the plate positioning reference pin, and the retaining plate depressing the top surface of the lithographic plate fitting the plate positioning reference pin; and a recess provided on the top portion of the clamping plate of the bite-side vise and receiving the plate positioning reference pin.

* * * * *